United States Patent [19]

Block et al.

[11] Patent Number: 4,533,851

[45] Date of Patent: Aug. 6, 1985

[54] HIGH-PRESSURE ELECTRIC DISCHARGE LAMP WITH INTERFITTING SOCKET AND SUPPORT

[75] Inventors: Werner Block, Taufkirchen; Wolfgang Greiler, Unterhaching, both of Fed. Rep. of Germany

[73] Assignee: Patent-Treuhand Gesellschaft, Munich, Fed. Rep. of Germany

[21] Appl. No.: 532,584

[22] Filed: Sep. 15, 1983

[30] Foreign Application Priority Data

Oct. 1, 1982 [DE] Fed. Rep. of Germany ..... 3236462

[51] Int. Cl.[3] ..... H01J 5/48; H01J 5/50

[52] U.S. Cl. ..... 313/51; 313/318; 313/623; 339/144 R; 339/186 R

[58] Field of Search ..... 313/623, 318, 51; 339/144 R, 145 R, 186 R, 186 M

[56] References Cited

U.S. PATENT DOCUMENTS 1,157,026 10/1915 Meschenmoser ..... 339/186 R X
3,341,731 9/1967 Wilson ..... 313/318 X
3,391,381 7/1968 Livingston ..... 339/186 M X
3,876,896 4/1975 Albrecht et al. ..... 339/145 R X
4,385,257 5/1983 Fitzgerald ..... 313/318

*Primary Examiner*—Robert Lindsay

*Attorney, Agent, or Firm*—Frishauf, Holtz, Goodman & Woodward

[57] ABSTRACT

A halogen-metal vapor lamp (1) with its electrodes coming out of the discharge vessel at opposite ends is provided with a highly insulated socket at one end capable of withstanding 30 kV that may have to be applied for warm ignition of the lamp. Contact pins (9,10) of the socket (11) and connection bushings (22,23) of the support (21) into which the socket plugs in, are provided with collars (15,16;25,26) which lengthen the breakdown path length. The fused seal (7) of the lamp through which the high voltage is applied is cemented in a central opening of the socket body and additionally surrounded in part by a collar (17). The other end of the lamp is connected to the socket by an uninsulated rigid conductor in the form of a metal strip to facilitate the dissipation of heat by radiation. A projecting partition (24) at the bottom of the support (21) separates the voltage supply connection to the connection bushings.

14 Claims, 10 Drawing Figures

HIGH-PRESSURE ELECTRIC DISCHARGE LAMP WITH INTERFITTING SOCKET AND SUPPORT

This invention concerns a high-pressure electric discharge lamp in which two electrodes are disposed on the longitudinal axis and at opposite sides of the center of a discharge vessel, each electrode having a current supply lead passing through the vessel at a fused seal surrounding the connection lead.

Lamp of the present invention are preferably used for illumination for film and video tape motion pictures and for stage lighting and similar purposes. In addition, these lamps are also useful, for example, for projection purposes or for general illumination.

Because of their constructional shape providing connections respectively at two ends of the discharge vessel, the high-pressure electrical discharge lamps are usually provided with a base piece at each end for receiving the connection pin passing through the fused seal at that end. The installation length is thereby made correspondingly large, for which reason the lamps had to be built into their associated reflectors oriented perpendicular to the longitudinal axis of the reflector. For that purpose, it was necessary to provide the reflectors with lateral cut-outs, so that the two lamp bases were both disposed outside of the reflector on one side and the other. This arrangement is not only an encumbrance, but it also reduces the useful light quantity because of the surface portions cut out of the reflector. In order to circumvent these problems, a lamp having both fused connections at the same end disposed parallel to each other, and having electrodes and current supply leads running parallel to each other and on either side of the longitudinal axis of the lamp was proposed, as is shown for example in DE-OS No. 24 02 422 and British Pat. No. 1 463 056, or DE-OS No. 27 07 605 and U.S. Pat. No. 4,099,081. In the case of these lamp vessels having their fused seals at the same end, at which a base can readily be provided, it is possible by the compact configuration to set the lamp axially in a reflector, so that cut-outs in the reflector surface which reduce the useful light quantity no longer need to be provided. An important disadvantage of these lamps, however, is that the electrical connections of the lamp are disposed in relatively close proximity to each other. For normal lamp operation that may well be adequate, but for the re-ignition for lamps warmed up by operation, new difficulties arise. A high voltage up to 30 KV is necessary for re-ignition of lamps that are still warmed up from operation. With the narrow spacing of the electrical leads and of the contacts in the socket and support, these high voltages produce arc-overs and, in the case of unfavorable conditions, even destruction of lightning components of high value.

SUMMARY OF THE INVENTION

It is an object of the present invention to provide a compact high-pressure discharge lamp together with its base and support socket which is suitable even for hot ignition and is of a configuration appropriate for being set completely within a reflector. The quantity of light given off by the lamp should not be reduced by cut-outs in the reflector surface.

Briefly, the socket and the support are made of material capable of insulating at high voltage, preferably ceramic, and the interfitting contact pins and bushings respectively provided in the base and the support are spaced with their centers far enough apart for being surrounded at some spacing by collars of highly insulating material. One of the contact elements of the base is disposed to make contact with the connection lead coming out of one end of the discharge vessel at a seal which is seated right there in the base, preferably centrally thereof, while the other contact element of the base has an extension going around to the other end of the discharge vessel of the lamp and is preferably constituted as a rigid flat conductor with its narrow dimension facing the lamp so as to provide effective dissipation of heat by radiation.

These features have the advantage that having only one of the fused-seal connections fitting into a base having two contact elements and made of a highly insulating material, and providing an extended conductor for supplying the electrical connection to the far end of the discharge vessel from the other contact element of the base, makes for high insulation capabilities, especially with the provision of the spaced collars for the interfitting contact elements of base and socket, especially with a projecting partition for separating the contact elements of the socket where they are fastened to the supply voltage. The lamp is advantageous for the applications mentioned at the beginning of this description and can advantageously be constituted as a halogen-metal vapor lamp operated with alternating current without an outer bulb. Because of its compact construction and the one-sided basing, it is particularly well-suited for small, handy illumination equipment for film and video tape motion picture camera equipment. Both the base and the support socket can be siliconized or glazed for protection against atmospheric moisture. Instead of a halogen-metal vapor lamp, however, it is also possible to use a high-pressure lamp without halogen additives or a noble gas lamp.

The contact elements of the base are preferably constituted as pins and the corresponding connection elements of the supporting socket as bushings, in each case at a mutual spacing D between centers which when measured in millimeters is not more than 0.8 times the value of the maximum ignition voltage, expressed in kilovolts, to be applied in the case of a lamp warmed up by operation.

The pins are surrounded by collars at a certain spacing therefrom, enclosing a cavity around them continuing at least for the entire length to which they project from the part of the base in which they are embedded. The collar that surrounds the contact element leading the high voltage to the lamp preferably surrounds that contact element around its entire periphery. In this way a sufficient insulation of the contact elements against each other is provided, as is necessary to prevent a breakdown of the high voltage during warm ignition of the lamp.

For assuring correct polarity of connections, the collars preferably have different cross-section.

The rigid extension conductor that goes from the base to the far end of the lamp vessel can be made, for example, of nickel-plated copper with its narrow edge facing the lamp for reduction of heat absorption. The large surface of the metal strip radiates away a large part of the heat that is generated. The fused seal mounted in the base is fastened in an opening in the molded body of the base and/or is surrounded by a collar at a certain distance extending at least in the region towards the metal strip. The total length $L_1$ provided by the depth of the opening and the height of the collar is at least as great as the spacing D between centers of the contact pins that engage the bushings of the socket. It is sufficient for the collar to surround the fused-seal end of the discharge vessel in substantially semicircular configuration on the side toward the opposite pole contact element.

The connection elements constituted as bushings are spaced by the distance D, measured between centers, and they make a force-fit with the contact pins of the socket. The plug connection between the pins of the base and the bushings of the supporting socket can conveniently be provided with means for preventing them from being easily pulled apart, for example in the form of an annular bead on each pin which corresponds with a snap ring groove within each bushing.

The two connection elements of the socket are separated one from the other by a partition that extends beyond the ends of these connection elements to which the voltage supply is connected by at least the length $L_2$ which is half the aforementioned spacing D. The width B of the partition preferably mounts to at least the value of the spacing D. As the result of these precautions, a high-voltage breakdown in the region of the underlying support is assuredly prevented. The bushings themselves are, moreover, surrounded for at least 180°, disposed towards the opposite pole of the connector, by a collar running at a certain spacing from the conductors. The connection element in the socket that serves for the high voltage is preferably surrounded about its entire periphery by the collar. For the connection element of the return current path, however, a collar not completely surrounding that element is sufficient. For assuring correct polarity of connections, the collars surrounding the connection elements of the socket are at least partly of different cross-sectional shape. The cross-sectional shape of corresponding contact pins and connection bushing elements, respectively of the base and of the socket, are fitted to each other. The support is also provided with means for affixing it to an illumination fixture. On account of the high heat loading, both the base and the socket are made of a heat-resistant material capable of providing insulation for high voltage, as for example a ceramic material, and the insulating portion of each of these pieces is made all in one piece.

BRIEF DESCRIPTION OF THE DRAWINGS

The invention is further described by way of illustrative example with reference to the annexed drawings, in which.

DESCRIPTION OF THE PREFERRED EMBODIMENT

Figure 1:
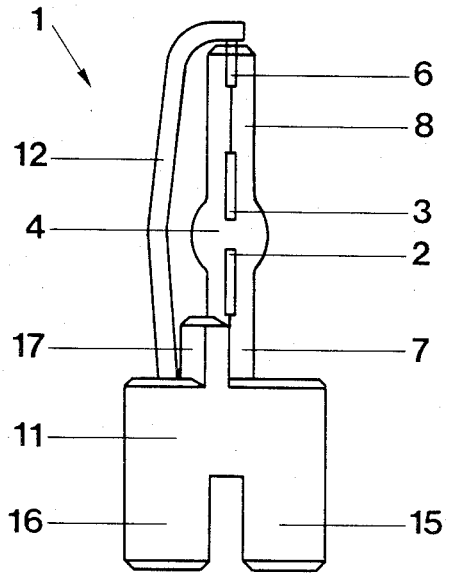
FIG. 1 shows, in front view, a halogen-metal vapor lamp with a base provided at one end of the lamp bulb.
Figure 2:
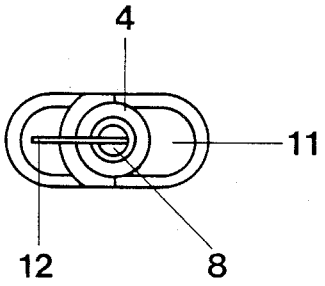
FIG. 2 is a top view of the lamp of FIG. 1.
Figure 3:
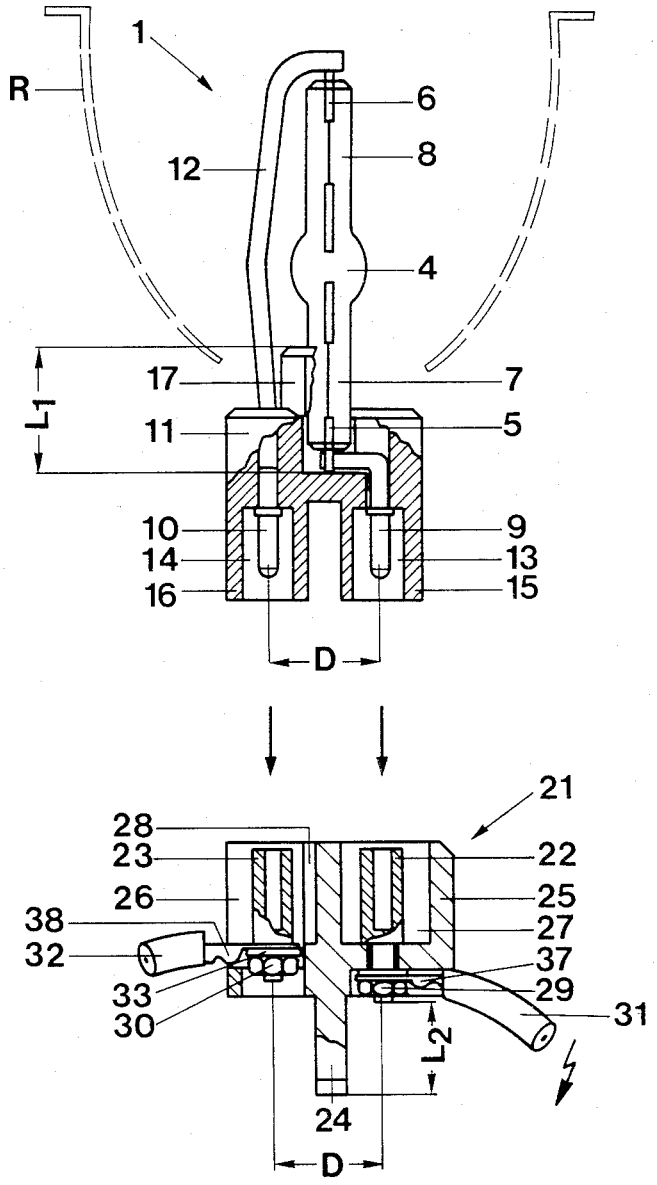
FIG. 3 shows, partly in section, a lamp of the kind shown in FIGS. 1 and 2 showing also the socket therefor in an exploded view separating the socket support from its interfitting base while keeping these parts in alignment.

FIGS. 1, 2 and 3 show a halogen-metal vapor lamp 1 which has a base only at one end. The two electrodes 2 and 3 are disposed on opposite sides of the center of the discharge vessel 4, each of the electrodes 2 and 3 having associated current supply pins 5 and 6 passing through the vessel by fused seals 7 and 8. The fused seal 7 is mounted in a base 11 having two contact pins 9 and 10. The current supply lead pin 5 of the discharge vessel facing the base 11 is directly connected electrically with the contact pin 9, while the electric connection of the current supply pin 6 disposed away from the base 11 is connected with the contact pin 10 of the socket by means of a flat, preformed, rigid, nickel-plated copper strip 12 which has its narrow edge facing the lamp 1. Good dissipation of heat by radiation is obtained during operation of the lamp by means of the nickel-plated copper strip 12. The spacing between the discharge vessel 4 of the lamp 1 and the nickel-plated copper strip 2 is about 5 mm.

The halogen-metal vapor lamp 1 illustrated in the drawings is operated in accordance with European practice with alternating current at 50 Hz and 220 volts and for a voltage of 45 volts across the lamp has a power consumption of 250 watts. A voltage in the range from 20 kV to a maximum 30 kV is required for ignition and in particular for re-ignition of a lamp that is warmed up from operation. This high voltage is applied through the contact pin 9 to the lamp 1. High voltage insulation corresponding to this requirement is necessary mainly for the components connecting and applying the high voltage. The two contact pins 9 and 10 are accordingly spaced by 19 mm between centers, this being shown on the drawing by the distance D and are fully surrounded for somewhat more than their exposed length by the respective collars 15 and 16 which form the cylindrical cavities 13 and 14. The position of a reflector R for the halogen-metal vapor lamp 1—for example in the case of an illumination fixture for film or video motion picture-taking—is indicated in broken lines in FIG. 3.

Figure 4:
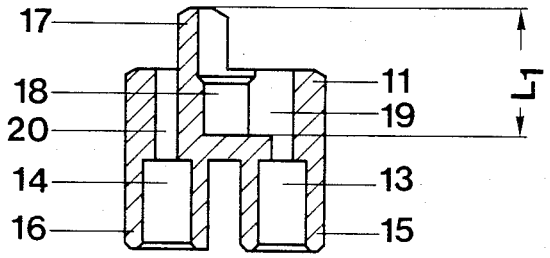
FIG. 4 is a cross-section of the molded insulating body of the base of the lamp of FIG. 3.
Figure 5:
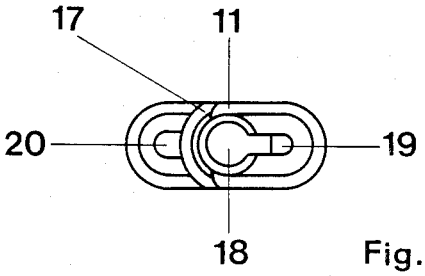
FIG. 5 is a top view of the molded insulating body of FIG. 4.
Figure 6:
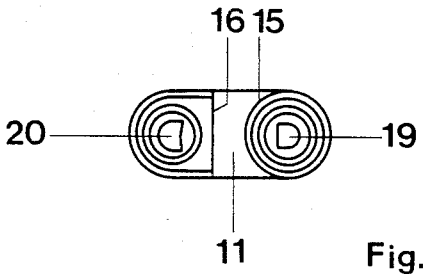
FIG. 6 is a bottom view of the molded insulating body of FIG. 4.
Figure 7:
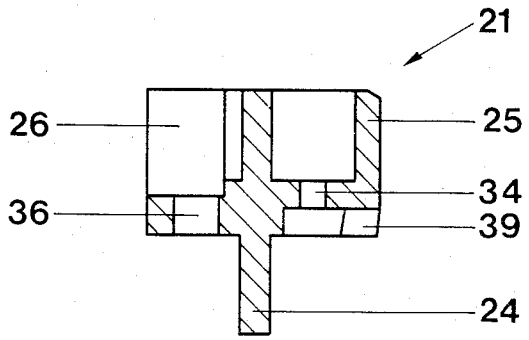
FIG. 7 is a section of the molded insulating body of the support of the lamp base for FIG. 3.
Figure 8:
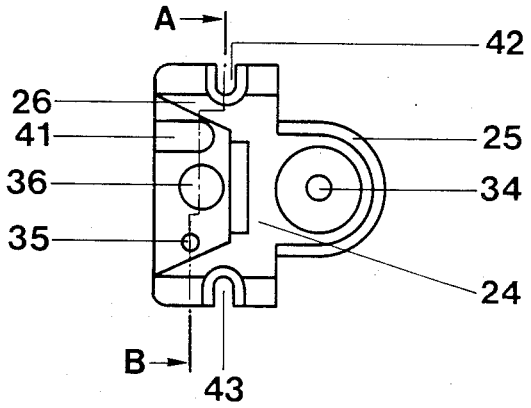
FIG. 8 is a top view of the molded insulating body of FIG. 7.
Figure 9:
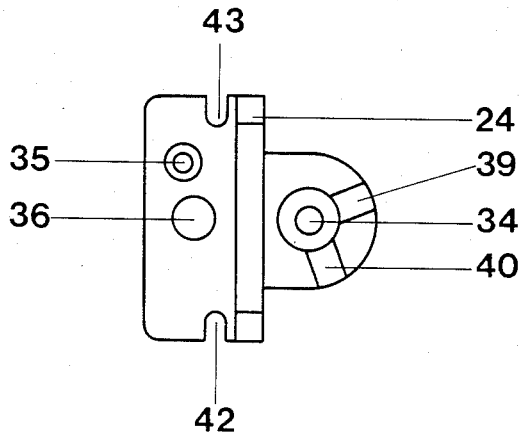
FIG. 9 is a bottom view of the molded insulating body of FIG. 7.
Figure 10:
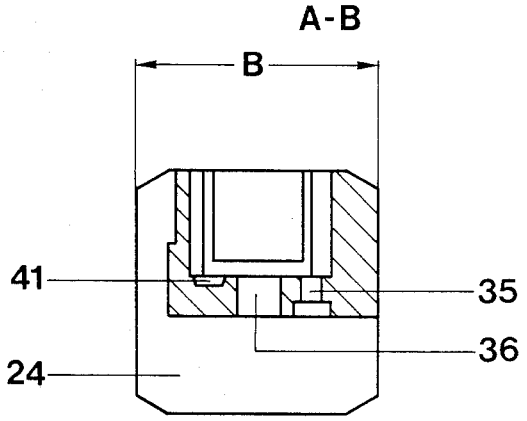
FIG. 10 is a stepped sectional view of the molded insulating body of FIG. 7 along the stepped plane indicated by the line A—B of FIG. 8.

FIGS. 4, 5 and 6 show the different aspects of the one-piece ceramic body of the lamp base, which has a configuration for assuring correct polarity of connections to the lamp by providing the high-voltage contact pin 9 with the surrounding collar 15 that is cylindrical in its wall shape, in contrast to which the wall surface of the collar 16 which has a plane surface on the inner side located towards the opposite pole of the connector. Furthermore, for insulation against high voltage, the fused seal 7 held fast in the base 11 has a more or less semicircular collar 17 about it at a certain spacing therefrom in the direction towards the copper strip 12. The height of the semicircular collar 17 is 10 mm in this example. The fused seal 7, moreover, is disposed in a round opening 18 in the central part of the base body. The overall length $L_1$ composed of the height of the collar 17 and the depth of the opening 18 is about 23 mm. For accommodation of the contact pins 9 and 10, the base body is also provided with corresponding openings 19 and 20.

Mechanical and electrical connection of all metal parts—on the one hand the contact pin 9 with the current supply lead pin 5, and on the other hand the current supply lead pin 6 with the nickel-plated copper strip 12 and the contact pin 10—is advantageously produced by hard soldering or spot-welding, in order to obtain a sufficient capability of withstanding heat during operation of the lamp. The components thus preassembled with hard soldering or spot-welding are then introduced into the base body. The remaining cavity spaces of the openings 18, 19 and 20 are then filled with a heat resistance and high voltage insulating cement (not shown in the drawings), and after the lamp is fitted to its base 11 with any adjustment that may be necessary, that cement is then hardened.

The support socket 21 into which the single-ended base of the halogen-metal vapor lamp 1 fits is shown in FIG. 3, and the shape of the corresponding insulating body of the socket is shown in detail in FIGS. 7, 8, 9 and 10. Like the base body, the insulating socket body is made in one piece of ceramic material. The connection bushings 22 ad 23 spaced on centers by the distance D of 19 mm, corresponding to the contact pins 9 and 10 of the socket 11, are separated for insulation from each other by a partition web or wall 24 which projects from the underside beyond the connection elements for a length $L_2$ of 13 mm. In order to prevent a voltage breakdown upon the ignition of the lamp 1, the length $L_2$ of this web 24 should be at least half of the distance D. The width B of the web 24 corresponds to the maximum width of the socket 21, which in the illustrated example is 40 mm.

For further insulation of the connection bushings 22 and 23 against high voltage, at least the bushing 22 that connects the high voltage is fully surrounded at a certain distance by a collar 25 over its entire exposed length. The corresponding counter-connection bushing 23 has only a collar 26 which is open to the exterior of the support 21. Between the connection bushings 22 and 23 and their respective collars 25 and 26, cavities 27 and 28 are provided. When a completed halogen-metal vapor lamp 1 is inserted in the socket 21, the collars 15 and 16 of its base 11 are inserted in these cavities 27 and 28 of the support. In this way the path of a possible spark breakdown is substantially lengthened, and the capability of the assembly to withstand, as can particularly be seen from FIG. 8, the collars 25 and 26 are constituted differently for assurance of correct polarity of connection and they are fitted into the configuration of the corresponding collars 15 and 16: the collar 25 has a round shape, in contrast with which the collar 26 has the plane surface of the web 24 on the side towards the other pole of the connection structure.

The connection bushings 22 and 23 are provided with threading at their lower ends, on which the connections of the supply lines 31 and 32 are made by means of the respective nuts 29 and 30. The connection bushing 22 supplying the high voltage is directly connected to the socket body, while the connection bushing 23 is screwed on it by means of a contact plate 33. This contact plate 33 has a trapezoidal shape, with its longest side facing the open side of the collar 26. Good cooling of the contact plate 33 is made possible by the open collar 26—e.g., with the help of a ventilating blower or fan (not shown) installed in an apparatus housing (likewise not shown).

Of course, other kinds of fastenings for the connection bushings 22 and 23 could be provided in the socket body. The openings 34, 35 and 36 in the support body are provided for the fastening of the connection bushings 22 and 23 in the insulating body. The latter is also provided with cavities 39, 40 and 41 for accommodating the terminal lugs 37 and 38 attached to the supply conductors 31 and 32. For affixation of the socket body 21—for example in a film or video tape camera lighting fixture—the support body has mounting slots 42 and 43 for attachment screws (the latter not being shown in the drawing).

Although the invention has been described with reference to a preferred and illustrative example, it will be understood that modifications and variations are possible within the inventive concept.

We claim:

1. High-pressure electric discharge lamp (1) comprising an elongated discharge vessel (4) having a longitudinal axis and a base (11) for holding and electrically connecting said discharge vessel and a socket (21) in combination therewith into which said base fits for mechanical support and electrical connections, said lamp further comprising two electrodes (2,3) respectively disposed towards opposite ends of said discharge vessel (4) on said axis, electrical connection leads (5,6) being provided for supplying an electrical connection through the wall of said vessel (4) for said respective electrodes, fused seals (7,8) surrounding said connection leads being provided in said vessel wall, said combination further having the improvement which comprises:

two contact elements (9,10) embedded in said base, one (9) of which is disposed for making contact with one (5) of said connection leads at one end of said vessel fitting into said base, and the other (10) of which is provided with an electrically conducting extension (12) for making contact to the other (6) of said connection leads which is the more remote from said base, said base being made of material capable of providing insulation at high voltage and having collars (15,16) of said material at least partially surrounding said contact elements at their extremities away from said vessel at a spacing from said respective contact element extremities, and third and fourth contact elements (22,23) set in said socket (21) for mechanically gripping engagement with said two contact elements (9,10) of said base and having means for supply voltage connection at their ends away from said base, said support being made of material capable of providing insulation at high voltage and having a partition web of said material separating said third and fourth contact elements at a spacing therefrom and projecting beyond the ends thereof having supply voltage connection means, as well as contributing to defining cavities (27,28) further formed by collar walls (25,26) of said material extending at least partially around the supply voltage connection ends of said third and fourth contact elements (22,23) at a spacing therefrom.

2. High-pressure electric discharge lamp and socket combination according to claim 1 in which said two contact elements (9,10) of said base (11) are constituted as pins and said third and fourth contact elements (22,23) of said socket are provided with bushings for insertion of said pins, said pins and bushings being aligned at a spacing D between centers which, as expressed in millimeters is at most 0.8 times the value in kilovolts of the maximum applicable ignition voltage of an operation-warmed lamp.

3. High-pressure electric discharge lamp and socket combination according to claim 1 in which said collars (15,16) fully surround ends of said contact elements (9,10) of said base (11) over at least their entire exposed length.

4. High-pressure electrid discharge lamp and socket combination according to claim 1 in which said collars (15,16) of said base have different cross-section for assuring correct polarization of the electrical connections.

5. High-pressure electric discharge lamp and socket combination according to claim 1 in which said base is provided in substantially central opening (18) facing said discharge vessel for seating the fused seal (7) of said discharge vessel surroounding lead (5) which in operating position makes contact with that one of said contact elements (9,10) which is not equipped with said extension (12).

6. High-pressure electric discharge lamp and socket combination according to claim 5 in which said central opening (18) is surrounded at least in part by a collar (17) disposed at least in the neighborhood of said contact element extension (12).

7. High-pressure electric discharge lamp and socket combination according to claim 6 in which the total length composed of the depth of said central opening (18) and the height of said collar (17) is at least as large as the spacing between centers of the portions of said two contact elements of said base, and likewise of said third and fourth contact elements of said socket.

8. High-pressure electric discharge lamp and socket combination according to claim 1 in which said contact element extension (12) is constituted as a flat preformed rigid metal strip.

9. High-pressure electric discharge lamp and socket combination according to claim 1 in which said partition web (24) of said socket extending beyond the connection means carrying ends of said third and fourth contact elements (22,23) has a length ($L_2$) which is at least half of the spacing between centers of the portions of said third and fourth contact elements which fit the two contact elements (9,10) of said base.

10. High-pressure electric discharge lamp and socket combination according to claim 9 in which the width of said partition web (24) is not less than said spacing between centers of said portions of said third and fourth contact elements (22,23).

11. High-pressure electric discharge lamp and socket combination according to claim 1 in which, in order to assure proper polarity of connections, said collars (25,26) of said socket (21) defining cavities around said respective contact elements (22,23) have different cross-sections and in which said collars (15,16) of said base (11) and the corresponding collars (25,26) of said socket (21) are, in the case of each corresponding pair, of configurations fitted to one another in their cross-sectional shape.

12. High-pressure electric discharge lamp and socket combination according to claim 1 in which said socket (21) is equipped with means (42,43) facilitating affixation of said socket.

13. High-pressure electric discharge lamp and socket combination according to claim 1 in which the insulating portion of said base (11) and said socket (21) are each made in one piece of ceramic material.

14. High-pressure electric discharge lamp and socket combination according to claim 1 in which the contents of said vessel (4) are suitable for a halogen-metal vapor lamp operable with alternating voltage.

* * * * *